US007472531B2

(12) United States Patent
Fennelly

(10) Patent No.: US 7,472,531 B2
(45) Date of Patent: Jan. 6, 2009

(54) ADAPTIVE RIDING PAD APPARATUS AND METHOD

(75) Inventor: Martine Fennelly, San Diego, CA (US)

(73) Assignee: Fleeceworks, Inc., City of Industry, CA (US)

( * ) Notice: Subject to any disclaimer, the term of this patent is extended or adjusted under 35 U.S.C. 154(b) by 502 days.

(21) Appl. No.: 11/218,805

(22) Filed: Sep. 2, 2005

(65) Prior Publication Data

US 2007/0051077 A1 Mar. 8, 2007

(51) Int. Cl.
*B68C 1/12* (2006.01)

(52) U.S. Cl. ..... 54/66

(58) Field of Classification Search ..... 54/44.1, 54/65, 66

See application file for complete search history.

(56) References Cited

U.S. PATENT DOCUMENTS 351,212 A * 10/1886 Shaffer ..... 54/66
2,461,899 A * 2/1949 Humphrey ..... 54/66
3,807,136 A 4/1974 Deal
3,971,194 A 7/1976 Morgan
4,136,506 A 1/1979 Miller
4,669,255 A 6/1987 Wicks
4,683,709 A 8/1987 Vasko et al.
4,695,496 A * 9/1987 Lee ..... 428/95
4,827,701 A 5/1989 Gonzales
4,974,397 A 12/1990 Ricken
5,018,341 A 5/1991 Evertson
5,027,589 A 7/1991 Gleb et al.
5,038,551 A 8/1991 Farmer
5,058,367 A 10/1991 Evertson
5,119,618 A 6/1992 Streck
5,175,986 A 1/1993 Farley
5,299,412 A 4/1994 Cudney et al.
5,353,577 A 10/1994 Thurston
5,363,631 A 11/1994 Garrison
5,375,397 A 12/1994 Ferrand et al.
5,456,072 A 10/1995 Stern
5,548,948 A 8/1996 Smith et al.
5,575,139 A 11/1996 Green
5,782,070 A 7/1998 Knight et al.
5,802,823 A 9/1998 Woods
6,050,067 A 4/2000 Knight et al.
6,067,781 A * 5/2000 Ford et al. ..... 54/66
6,125,616 A * 10/2000 Brown ..... 54/66

(Continued)

FOREIGN PATENT DOCUMENTS

DE 29800448 U1 3/1998

(Continued)

*Primary Examiner*—Rob Swiatek
(74) *Attorney, Agent, or Firm*—Gazdzinski & Associates

(57) ABSTRACT

Riding apparatus and methods for use on animals. In one exemplary embodiment, the apparatus comprises a saddle pad system with pad elements that are resiliently mounted to a central element so as to allow relative motion therebetween in at least one dimension. The resilient couplings absorb stress placed on the pad, thereby relieving stress on the central element (which is disposed proximate to the animal's spinal region), and optionally the withers region. Sheepskin contact elements are also optionally used to interface with the animal in order to provide maximal comfort, thermal properties, and moisture dissipation, as well as pressure dissipation. Methods of using the pad apparatus, and for manufacturing the same, are also disclosed.

27 Claims, 10 Drawing Sheets

U.S. PATENT DOCUMENTS

| | | | | |
|---|---|---|---|---|
| 6,370,850 | B1 | 4/2002 | Zilka | |
| 6,415,583 | B1 | 7/2002 | Landi et al. | |
| 6,421,989 | B1 * | 7/2002 | Leson | 54/66 |
| 6,434,916 | B1 | 8/2002 | Tucker | |
| 6,474,052 | B2 | 11/2002 | Kempsell et al. | |
| 6,574,947 | B2 | 6/2003 | Landi et al. | |
| 6,615,568 | B1 | 9/2003 | Roskies | |
| 6,640,525 | B1 | 11/2003 | Coats | |
| 2002/0104295 | A1 | 8/2002 | Rauch | |
| 2002/0189211 | A1 | 12/2002 | DeCosemo | |
| 2003/0177742 | A1 | 9/2003 | Brownlie | |
| 2005/0086914 | A1 | 4/2005 | Fennelly | |

FOREIGN PATENT DOCUMENTS

| | | | |
|---|---|---|---|
| GB | 2282742 | A | 4/1995 |

* cited by examiner

ADAPTIVE RIDING PAD APPARATUS AND METHOD

RELATED APPLICATIONS

This application is related to U.S. patent application Ser. No. 10/692,835 filed Oct. 23, 2003 and entitled "Riding Apparatus and Method", incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

This invention relates generally to the field of riding living animals, and specifically in one exemplary aspect to improved apparatus and methods for saddle padding for, e.g., equine applications.

2. Description of Related Technology

A great variety of approaches to riding (e.g., saddle) pads for use on ambulatory animals have been disclosed in the prior art. Generally, these pads are meant to provide an interface between the animal and the saddle or other structure which is both comfortable to the animal and sufficiently robust in terms of undesired movement, slipping, or rotation of the saddle (and/or pad) on the animal during use.

Due to the large variability in the anatomy of such animals (even within a particular breed of a particular species), the physical attributes of the saddle-animal interface are similarly very unique. Significant time and effort is characteristically expended by the animal rider in trying to obtain and adjust a properly fitting saddle and pad combination. Furthermore, since the anatomy of a given animal may vary over time such as due to aging, weight gain/loss, muscle tone, etc.), what may be a well-fitted saddle and pad at one point in time may be unsuitable or ill-fitted at another.

When a saddle and pad are not properly fitted, several disabilities can result including, inter alia, the creation of a small number of localized "pressure points" under the saddle where the majority of saddle/rider weight is carried. Much akin to an ill-fitted pair of shoes, this localization of force can rub or abrade the skin of the animal rapidly, thereby causing substantial discomfort.

A significant disability associated with prior art saddle pad arrangements relates to their lack of compliance with respect to portions of the animal's anatomy. Most notably, these prior art solutions do not sufficiently account for the variation in position and movement of the spinal column of the animal. This movement can be appreciable, and if constrained or otherwise restricted in any way, can cause both significant discomfort to the animal, and adjustments in posture and/or movement which may be deleterious to the animal over time. Reduced blood flow may also result, due to the compression of blood vessels in the affected regions resulting from the lack of compliance of the saddle during motion of the spine.

The interface between the saddle and the underlying saddle pad will typically occur in the regions 102 of the pad 100 peripheral or lateral to the animal's spinal column 104. The weight of the saddle (and the rider), coupled through these regions of the saddle pad, tends to pull the pad taught downward against the top surface of the spine 104, as best shown in FIGS. 1 and 1*a*. This effect also occurs relative to the withers region of the animal (i.e., the shape of the withers region and the lack of compliance of the saddle pad in this region causing undesired stress and tension).

This taught condition is problematic in multiple respects, including (i) the creation of an undesired downward loading and compression of the spine and nearby tissues (and withers region, discussed below) which may not exist absent the pad; (ii) the abrasion of the pad material against the animal's skin due to the relative motion of the spine and the pad which inevitably occurs during riding; and (iii) the tendency of the lateral portions of the saddle pad to increasingly "walk" downward on the sides of the animal under the varying pressure and friction between the saddle and the pad during riding, thereby further increasing the effects of items (i) and (ii) over time.

As can be appreciated, attempts at avoiding the foregoing problems (such as by bunching up the saddle pad over the spine to avoid contact between the spine and the pad) are short lived and ineffective at best; the lateral portions of the pad will invariably walk down the sides of the animal during riding so as to draw the portion of the pad over the spine taught. Similarly, placing padding material between the spine and the pad may reduce skin abrasion somewhat, yet can cause a host of other problems, such as restricting the free motion of the spine during riding (which is actually quite variable in relation to the saddle). Furthermore, unless the interposed padding material is substantially incompressible, it will simply act as an extension of the pad and flatten against the spine, in effect providing little difference from the pad itself. Conversely, if the interposed padding is substantially rigid or incompressible, it may cause even greater discomfort to the animal since it will not readily adapt to the shape of the animal's spine even under the compressive force of the saddle pad.

The foregoing disabilities are further exacerbated in so-called "high withered" animals, since the contact surface area in the withers region is diminished, thereby causing the increased force to be distributed in localized regions. This localized application of pressure can cause the saddle pad to exert even greater force on the animal's spine and/or withers region, since the localized application of pressure reduces the overall or effective coefficient of friction between the saddle pad and the animal's skin. This reduced friction allows the saddle pad to slide or walk more rapidly down the sides of the animal during riding, and hence be less resistant to forces tending to place the saddle pad in tension over the animal's spine or withers.

One exemplary prior art saddle pad solution comprises the so-called CorrecTOR device. This device comprises what is advertised as in effect a "parallel scapula". It is intended to be substantially universal in nature; i.e., one device is used with many different horses and saddles, and not custom fitted. Only the size has to be adjusted per standard or large saddles, English or Western. The exemplary device contains multiple flexible protective shields which are positioned to protect against so-called "saddlesoreing". The CorrecTOR lays under the pad against the horse. It is approximately 0.375 in. thick or less. These "tablet" type solutions, however, have the distinct disability of substantially interfering with the spine of the animal during movement.

Similarly, the Ortho-Flex device manufactured by Orthoflex Saddleworks, Inc. attempts to provide an improved saddle solution. Traditional saddles often use a rigid tree made from wood or other synthetic hard materials which are placed directly on the horse's back. When this traditional rigid tree is girthed to the horse it is substantially equivalent to a splint on the horse's spine. The horse's performance may suffer because they will learn to limit their movement to avoid interference with the solid tree saddle. The Ortho-Flex system incorporates a rigid tree, but isolates it from the horse's back with two flexible panels which contour to fit the horse and flex while riding. The saddle tree ostensibly never touches the horse with an Ortho-Flex saddle.

A variety of other approaches are reflected in the prior art. For example, U.S. Patent Application Pub. No. 20030177742 to Brownlie, published Sep. 25, 2003 and entitled "INTERFACE PADS" discloses interface pads having a right and a left inflatable member with the volume of air in each of these inflatable members being independently adjustable. Each member is adapted to provide an interface between one side of a load-bearing animal and a load-supporting structure such as a saddle. Connecting means span the spinal area of the animal and link the members to one another in a manner that avoids the placement of any substantial compression on the animal's supraspinous ligament. Moreover, a gullet channel is maintained so as to allow appropriate ventilation in this area. The inflatable members are constructed of a foam core wholly surrounded by and bonded to a pair of thin skins or panels, forming a fluid tight envelope. A valve is disposed between the chamber formed by the envelope and the ambient environment. After allowing inflation of an air pad of this type and placing a load (such as the saddle and/or rider) thereon, the valve can be opened. In this situation, the air pad will conform to the contours and configuration of both saddle and animal until it reaches a point where the pressure exerted by foam and air remaining in the foam matches the exterior pressure placed on its various parts.

U.S. Patent Application Pub. No. 20020189211 to DeCosemo published Dec. 19, 2002 and entitled "Treeless jumping saddle and method of making the same" discloses a treeless saddle comprising a layered arrangement of flexible leather and foam, without including a rigid saddletree or frame. In particular, the saddle comprises two lower body half sections sewn together to define a saddle body. An underside of said saddle body includes two back contacting pads that define a recessed gullet region therebetween. A removable gullet pad may be provided for releasable securement with the gullet region. The saddle further comprises additional layers of soft leather and foam shaped to define an upwardly extending pommel, an upwardly extending cantle, and a lowered seat area positioned therebetween. The arched and contoured shape of the saddle, therefore, is defined by soft foam and leather and not by a rigid steel or wooden internal frame.

U.S. Patent Application Pub. No. 20020104295 to Rauch published Aug. 8, 2002 and entitled "MULTI-LAYER SADDLE PAD" discloses a multi-layer equine saddle pad. The saddle pad is made of non-woven polypropolene material that is both ostensibly durable and has high-moisture performance. The multiple layers are attached by stitching or bonding together along their centerlines such that the attachment terminates short of either end of the non-woven material layers. The multiple-layer pads are maintained free from any permanent attachments along their edges.

U.S. Pat. No. 6,640,525 to Coats issued Nov. 4, 2003 entitled "Saddle pad" discloses a saddle pad for distributing pressure over a greater area on the animal's back, thus reducing pressure points. The saddle pad works by providing a bar cutout area that is thinner than the remainder of the saddle pad. Saddle skirts, while somewhat flexible, generally have some rigidity. The saddle is placed over the saddle pad with the tree resting over the thinner, bar cutout area, while the remainder of the saddle skirt rests over the thicker, standard area. The skirt flexes outwardly slightly, but as it resist further outward flexion, there is an equalization of the pressure exerted from the saddle and rider over the entire underside of the saddle rather mainly under the tree. In this manner, downward force is distributed.

U.S. Pat. No. 6,615,568 to Roskies issued Sep. 9, 2003 and entitled "Method for customizing a saddle to a horse and apparatuses thereof" discloses a method for customizing the fit of a saddle to a given horse and apparatuses thereof. The method comprises a step of inserting under a saddle disposed on the horse's back, a cushion pad previously shaped to uniformly distribute the pressure of the saddle on the horse. The method may further comprise a step of shaping the cushion pad by disposing on the horse's back an impression pad which contains a putty-like material to imprint the relief pattern of the pressure distribution of a saddle disposed on the horse's back. This is followed by setting the saddle on the impression pad, by riding the horse to imprint a relief pattern of the pressure distribution of the saddle on the impression pad, and by shaping the cushion pad by reproducing the relief pattern of the impression pad.

U.S. Pat. No. 6,574,947 to Landi, et al. issued Jun. 10, 2003 and entitled "Method of making a saddle pad" discloses saddle pads for placement between a saddle and a horse's back, or between a saddle and the rider, for therapeutic and cushioning protection for the horse and for the rider. The saddle pads incorporate a perforated honeycomb cellular structure which contours to the horse's back and/or the saddle to provide uniform load distribution. The honeycomb cells of the pad are aligned perpendicular to the horse's back and flex with movement to reduce shear forces against the horse's skin. The ability of the honeycomb to contour and flex with the movement helps keep the pad securely in place, eliminating rubbing and chafing. See also U.S. Pat. No. 6,415,583 to Landi, et al. issued Jul. 9, 2002 and entitled "Saddle pad".

U.S. Pat. No. 6,474,052 to Kempsell, et al. issued Nov. 5, 2002 entitled ""Western" style saddles" discloses "Western" style saddles allowing existing saddles to be converted to a European saddle panel style which will facilitate a method of modeling the underside of the saddle to fit a horse's back. There is described a panel adapted for mounting to an underside of a skirt of a saddle, the panel comprising a sheet of a padded material and a sheet of a flexationally resistive material, the sheets being generally shaped to match a shape of the skirt to which the panel will be secured, and wherein the sheets are bonded together generally around their edges to define a pocket therebetween; and wherein the pocket is filled with a resilient medium. The resilient medium may be conventional flocking, but preferably comprises at least one inflatable bladder. The use of two generally coplanar inflatable bladders arranged to provide an overlap between the two bladders, is preferred.

U.S. Pat. No. 6,434,916 to Tucker issued Aug. 20, 2002 and entitled "Shock absorbing anatomically sculptured saddle seat" discloses a saddle seat adaptable to most "western" styled saddle tree and saddle jockey constructions. It is comprised of a base section that is flexible for absorbing some of the concussion related to the normal movement from a horse while being ridden. It is constructed of a single piece of flexible material of medium rigidity that attaches to the front and rear of the saddle tree, being positioned to result in it's elevation above the top surface of the saddle tree bars. It also includes a sculptured pad assembly comprising a seat padding being two pieces of firm padding material attaching to a saddle jockey construction to provide cushion for the riders hip bone and some elevation for clearance and relief of the riders groin, pelvic and genitalia area. Covering the sculptured and contoured seat padding is a layer of top padding and a seat cover, both being attached to a saddle jockey construction.

U.S. Pat. No. 6,421,989 to Leson issued Jul. 23, 2002 and entitled "Saddle pad" discloses a saddle pad having a first panel with a plurality of channels extending transverse to a longitudinal axis of the first panel, a second panel having a plurality of channels extending transverse to a longitudinal axis of the second panel, and a connector strip secured on one side to the first panel and on an opposite side to the second panel. Each of the first and second panels includes a first layer of a thermoformed polymeric material and a second layer of a leather-like material affixed to the first layer. The thermoformed polymeric material is ethylene vinyl acetate. The channels open to respective edges of the first and second panel and to the connector strip.

U.S. Pat. No. 6,370,850 to Zilka issued Apr. 16, 2002 entitled "Saddle pad" discloses devices and methods for reducing compressive and concussive forces to the back of an animal. Such compressive and concussive forces can cause pain, soreness and discomfort to an animal carrying a load on its back. In one embodiment, the invention provides a pad for use between a load interface and the animal's back. The pad is made of at least two distinct materials, each having a different resistance to compression and ability to absorb concussive and compressive forces. In one embodiment, a first material is sized to fit over a substantial portion of the animal's back covered by the load interface. A second material, of different physical characteristics from the first material, is positioned on or within the first material to cover selected areas of the animal's back which are subject to increased compressive and concussive forces between the load interface and the animal's back. The second material preferably has greater resistance to compression and an increased ability to absorb concussive and compressive forces than does the first material.

U.S. Pat. No. 6,125,616 to Brown ("Ortho-Flex") issued Oct. 3, 2000 and entitled "Load leveling saddle pad" A load leveling saddle pad for placement on the back of an equine animal such as a horse or mule beneath the saddle which uses a load leveler to fill depressions behind the scapula thereby building a more even surface for the bearing load. The saddle pad includes a pair of interconnected aprons which extend over the ribs and shoulders of the animal, with the load leveler being positioned on the aprons for positioning behind the scapula of the animal, the load leveler including at least one shim and an attachment member which releaseably couples the shim to the apron. Preferably, a thin bridging material is used to connect the aprons along their respective top edges to avoid pinching of the animal, with holes provided along the upper ridge thereof for ventilation. A plurality of shims are preferably provided in stacked, stairstepped relationship to avoid pressure transmission to the musculature of the animal and distribute the load, with each shim being releaseably and adjustably connected to the shim or apron therebeneath. Hook and loop fabric, such as Velcrog®, is preferably used to permit releasable and adjustable coupling of the thin padded shims to provide proper load leveling of the horse's back to accept the saddle.

U.S. Pat. No. 6,067,781 to Ford, et al. issued May 30, 2000 and entitled "Saddle pad" discloses an equine saddle pad for use in direct contact with the animal's hide and hair. The pad is constructed from a mat of piled polymer filaments extruded into an elongated continuity of about ½ inch thickness having 65% to 80% void volume within a thermally bonded matrix of approximately 10 mil to 30 mil diameter filaments. In one alternative embodiment of the invention, a hinge band of reduced thickness and void volume is heat formed along the pad center to divide the pad into two substantially symmetric leaves. Another alternative embodiment comprises a unitized overlay of the polymer filament pad by a dissimilar material such as neoprene foam, felt, woven nylon, woven or knitted polyester, cotton, wool or linen.

U.S. Pat. No. 6,050,067 to Knight, et al. issued Apr. 18, 2000 and entitled "Method and apparatus for padding and cushioning an equine saddle" discloses a method and apparatus for padding and cushioning an equine saddle for use between the saddle and the equine's back. The apparatus consists of a pad that includes an inner layer resistant to moisture and an outer layer for contacting the equine's back and the underside of the saddle. The pad includes a pocket for receiving an inflatable/deflatable cushion that enhances the animal's comfort.

U.S. Pat. No. 5,802,823 to Woods issued Sep. 8, 1998 and entitled "Shock absorbing panel assembly for saddles" discloses a shock absorbing panel assembly for positioning beneath a saddle. The assembly includes right- and left-hand panels for positioning in pockets in a saddle pad or blanket on the right- and left-hand side of a horse's back. Each panel is of multi-layer construction and includes a base with at least one layer of foam or other cushioning material and one layer of non-cushioning material. The base has at least two recesses and a shock absorbing pad is mounted in each recess to project out of the recess. Each pad also has two layers of cushioning material with an intervening layer of non-cushioning material.

U.S. Pat. No. 5,782,070 to Knight, et al. issued Jul. 21, 1998 and entitled "Method and apparatus for padding and cushioning an equine saddle" discloses a method and apparatus for padding and cushioning an equine saddle for use between the saddle and the equine's back. The apparatus consists of a pad that includes an inner layer resistant to moisture and an outer layer for contacting the equine's back and the underside of the saddle. The pad includes a pocket for receiving an inflatable/deflatable cushion that enhances the animal's comfort.

U.S. Pat. No. 5,575,139 to Green issued Nov. 19, 1996 and entitled "Non-slip saddle pad" discloses a saddle pad for use on horses or other animals which provides a stable and secure buffer between the animal and a saddle or harness. The pad of the present invention avoids the slippage and play (movement) associated with ordinary saddle pads by providing a layered saddle pad, the lowest layer of which is made of an open-celled foam from which the bottom surface skin has been stripped off. The open cells of the stripped foam come into direct contact with the back of the animal and act as miniature suction cups over the entire bottom of the pad providing good adhesion and preventing the pad (and hence, any saddle mounted on it) from slipping around while in use.

U.S. Pat. No. 5,548,948 to Smith, et al. issued Aug. 27, 1996 and entitled "Inflatable saddle support apparatus" discloses an inflatable saddle support apparatus which is characterized in a first preferred embodiment by an inflatable saddle bladder that fits beneath a saddle and serves to equalize the pressure applied by the saddle and rider to a horse. The saddle bladder is shaped to effectively fill the voids between the saddle and the horse and is attached to a felt pad by a seam or by means of loop-pile fasteners. A segment of a conventional saddle blanket is first placed on the horse and receives the saddle bladder, with the felt pad positioned on top of the saddle bladder. The saddle blanket is then folded over the felt pad to receive a saddle. The saddle bladder may be inflated without dismounting by squeezing an inflation bulb which communicates with the inflation chamber of the saddle bladder to provide a selected degree of pressure equalization between the saddle and the horse.

U.S. Pat. No. 5,456,072 to Stern issued Oct. 10, 1995 entitled "Saddle with gel-cushion for providing comfort to the user" discloses a saddle with gel-cushion for providing comfort to the user, comprising a saddle tree formed of a rigid material having an upwardly extending front edge, a rearwardly extending back edge and sides; a flexible sheet material covering the tree on the lower surface of the tree and the upper surface of the tree and coupled around the periphery thereof to encompass the tree; a pocket formed beneath the sheet material and the tree; a pocket formed beneath the sheet material above the tree and between the material of the flaps; a bladder formed of a liquid impervious material having an exterior sheet and interior sheet and secured around the periphery thereof located within the pocket; a plurality of horizontally disposed channels formed in the bladder by lines of connection coupling the exterior and interior sheets of the bladder along spaced horizontal lines; and a quantity of gel material located in each of the channels adapted to deform under pressure created by the person riding on the saddle.

U.S. Pat. No. 5,375,397 to Ferrand, et al. issued Dec. 27, 1994 and entitled "Curve-conforming sensor array pad and method of measuring saddle pressures on a horse" discloses a sensor array pad for sensing the pressure distribution under a saddle on the back of a horse. The pad includes a membrane made of first and second, identical substantially non-stretchable, flexible membrane portions. The membrane portions have adjacent facing edges that are joined at two spaced-apart tabs. A plurality of sensors are distributed substantially uniformly on the membrane, with each sensor occupying a predetermined surface area. Conductors are mounted on the membrane to extend between the sensors and a position along the perimeter of the associated membrane portion to provide for external connection with monitoring equipment. The membrane portions further each have a pair of slits extending from a mid-region spaced from the respective facing edge outwardly in diverging directions along lines passing outside the predetermined areas of the membrane occupied by the sensors. The slits define an upper section extending generally along the spine of a horse and a side section extending down the side of the horse away from the spine. When placed on the back of a horse with the facing edges extending along the spine, the membrane generally conforms to the back of the horse with the upper and side sections separating by spreading of the slits. The membrane may also be stretchable between the individual sensors. Pressures sensed by the sensors are input to a computer which generates a display of the pressure distribution.

U.S. Pat. No. 5,363,631 to Garrison issued Nov. 15, 1994 and entitled "Shock-reducing saddle pad" discloses an improved shock-reducing saddle pad comprising a layer of polyurethane foam having an upper side to which is attached a T-shaped pocket. Inside the T-shaped pocket there is a plastic-encased impact dispersing gel mold. A cover material is placed over the entire upper side of the layer of polyurethane foam, including the T-shaped pocket filled with the gel mold. To the under side of the layer of polyurethane foam there is attached a layer of a lightweight, elastomeric rubber which, while also absorbing downwardly directed impact forces, conforms to the contour of the horse's back, preventing slippage of the saddle pad and saddle, though not absorbing sweat.

U.S. Pat. No. 5,353,577 to Thurston issued Oct. 11, 1994 and entitled "Reversible saddle pad" discloses a reversible saddle pad having first and second opposing sides which may be alternately displayed under a saddle. An aperture is provided adjacent each saddle pad billet keeper for removably receiving the billet keeper therethrough.

U.S. Pat. No. 5,299,412 to Cudney, et al. issued Apr. 5, 1994 and entitled "Impact absorbing equestrian saddle pad" discloses equestrian saddle pads, especially adapted for energy or impact absorption, so as to save the horse. The saddle pad is characterized by a pair of side flaps hinged along a common axially extending top edge alignable with the vertabra of a horse such that each side flap extends over the top sides of the horse. An inner pocket is conformed in each side flap so as to contain an impact absorbing foam core. The foam core includes a center of open cell foam, enclosed by inner and outer layers of closed cell foam. The open cell center provides an impact absorbing air system. The inner and outer layers of closed cell foam contribute to energy absorption and, also, enable the pad to mold to each horse's individual conformation, thereby eliminating pressure points that cause soreness.

U.S. Pat. No. 5,175,986 to Farley issued Jan. 5, 1993 and entitled "Orthopaedic {sic}saddle pad" discloses a pad for a saddle includes a number of layers of compressible material. The layers fill the space between the saddle and the spine of the animal formed by the gullet of the saddle. Lower layers of the compressible material are contiguous with the upper layers and evenly distribute the load of the saddle over the back of the animal.

U.S. Pat. No. 5,119,618 to Streck issued Jun. 9, 1992 and entitled "Saddle-fault correcting saddle pad" discloses a corrective saddle pad for use under a saddle to provide a better fit of the saddle on a horse's back. The pad is in two portions connected by adjustable straps so as to sit on opposite sides of the horse's backbone. It further comprises a pair of washable inner pads and a pair of corrective outer pad releasable attached to one another. The washable inner pads have a layer of neoprene foam rubber in contact with the horse's skin to prevent rubbing and chafing. Each corrective outer pad is a multi-layer pad including a resiliently flexible pressure plate disposed along a support area of the horse's back along side the backbone and at least one packet filled with a fluid gel of a silicone material to transfer localized forces from the saddle across the pressure plate which has deformed to the shape of the horse's back thereunder whereby the packets lie against the pressure plate members with the fluid confined therein between the saddle and the pressure plate members so that localized forces from the saddle are hydraulically transferred over the surface of the pressure plates and over a broad area of the back of the horse. Provision is made to support the cantel portion of an English saddle when placed high on the horse's withers to prevent breakage of the saddle tree when jumping.

U.S. Pat. No. 5,058,367 to Evertson issued Oct. 22, 1991 and entitled "Molded saddle pad" discloses a back pad contoured to fit between a saddle pad on a horse's back and a saddle, having a cushioning action which affords comfort both to the horse and rider by absorbing the shocks caused by the concussive impact of the horse's movement and the rider's movement. The pad is a unitary, molded pad made from a shock-absorbing polymeric material, having a raised area in the portion which rises over the horse's withers, a central channel which runs longitudinally down the center of the pad, which channel has several ventilating holes, and raised cushioning portions disposed laterally on each side of the channel, which cushioning portions absorb shocks, minimize soreness of the horse caused by the saddle, and lift the front panels of the saddle away from the horse's shoulders.

U.S. Pat. No. 5,038,551 to Farmer issued Aug. 13, 1991 and entitled "Saddle seat riser pad" discloses a saddle backing, particularly but not solely adapted for English-type saddles, comprising a one-piece member having multiple curved portions that are basically in conformance with the back of a horse. The one-piece member has a frontal edge and a posterior edge, as well as two side edges, along with an upper surface and a lower surface, and the forward edge has a height which is less than the rear edge, and wherein the side edges taper from a relatively larger width or height at the posterior end towards the frontal end. The lower surface of the member is shaped in reciprocal conformance to the upper surface of the portion of the horse's back to which a saddle is generally appended. The device functions as a saddle riser pad.

U.S. Pat. No. 5,027,589 to Gleb, et al. issued Jul. 2, 1991 and entitled "Foam receiving envelope pad" discloses a foam receiving envelope pad for use beneath a horse saddle. In one embodiment, the envelope pad is interposed between a standard horse pad and the saddle; while in the second embodiment, the envelope pad is integrated into the standard horse pad. In both instances, the construction features the inclusion of an upper surface rearwardly narrowing top gusset followed by an integrated elongated flat panel, the pair of which separate each of two side envelopes from each other. Each envelope in use is downwardly disposed and is adapted to removably receive a special shock absorbing foam insert. The overall configuration of the envelope pad is correlated with the configuration of the saddle for which its use is intended.

U.S. Pat. No. 5,018,341 to Evertson issued May 28, 1991 entitled "Molded saddle pad with encapsulated layers" discloses a back pad having an encapsulated design contoured to fit between a saddle pad on a horse's back and a saddle, having a pronounced cushioning action which ostensibly affords comfort both to the horse and rider by absorbing the shocks caused by the concussive impact of the horse's movement and the rider's movement. The pad is a unitary, molded pad made from a shock-absorbing polymeric material, having a raised area in the portion which rises over the horse's withers, a central channel which runs longitudinally down the center of the pad, which channel has several ventilating holes, and raised cushioning portions disposed laterally on each side of the channel, the cushioning portions having encapsulated therein one or more shock-absorbing layers and a layer of air.

U.S. Pat. No. 4,974,397 to Ricken issued Dec. 4, 1990 and entitled "Anti-stress saddle pad for horses" discloses anti-stress saddle pads designed to relieve the pressure, shock forces and stress on a horse's spine, back muscles and top of its shoulders. The basic structure of the saddle pad is formed of multiple layers of material that from top to bottom are as follows: a sheet of felt, a sheet of visco-elastic polymer, and a sheet of open-celled polyurethane foam. The sheet of visco-elastic polymer functions to absorb shock forces transmitted to its top surface by a horseback rider and to dissipate this force laterally throughout the layer of material. The sheet of open-celled polyurethane foam absorbs impact shocks and vibrations and it has the ability to allow its bottom surface to conform to the contour of a horse's back.

U.S. Pat. No. 4,827,701 to Gonzales issued May 9, 1989 and entitled "Saddle pad construction" discloses a saddle pad for a horse or the like, the pad having a predetermined saddle-supporting contour and comprising an upper pad portion and a lower pad portion. Flexible and resilient cushioning members are disposed between the upper and lower pad portions, and are located in the areas where the seat and upper leg portions of a rider apply pressure to the horse during riding movement. The cushioning members serve to cushion shocks on the back and sides of the horse to prevent soreness and lameness of the horse, and to improve the comfort of the rider.

U.S. Pat. No. 4,695,496 to Lee issued Sep. 22, 1987 and entitled "Skin protective pad" discloses a multi-layer skin protective pad which is suitable for use as a saddle pad, a mattress pad, and other uses, comprises four layers of material. A first layer is adapted for placement against the body of a horse (for a saddle pad) or the body of a person (for a mattress pad) and is made of a plurality of elongated hydrophobic fibers which wick moisture and perspiration away from the body. A water storage and energy dissipation cushion layer made of foam material is attached to the first layer through a hydrophobic membrane layer which has pore sizes to permit passage of water vapor from the first layer to the cushion layer, and which blocks the passage of water droplets in the opposite direction from the cushion layer to the first layer. The opposite side of the cushion layer is covered with a water impervious protective layer, typically made of vinyl material.

U.S. Pat. No. 4,683,709 to Vasko, et al. issued Aug. 4, 1987 and entitled "Saddle pad" discloses a saddle pad and more particularly to an energy absorbing saddle pad which serves to minimize the amount of shock or energy transfer which occurs between a horse and its rider. The saddle pad, which is generally for use in conjunction with a saddle, comprises a soft moisture-absorbing layer for use next to the horse's coat and a tough abrasion resistant and absorbent layer for use next to the saddle. Included between the two layers are a pair of pockets each of which contains a removable and replaceable, lightweight, visco-elastic shock absorbing insert. The pockets are located within the pad such that when the pad is properly installed upon the horse the pockets align an insert on each side of the horse's spine in a position parallel and adjacent to the spine. Preferably, each side of the pad includes adjustable straps and a loop through which the lower portions of a saddle may be threaded to ensure the secure attachment of the pad to the saddle.

U.S. Pat. No. 4,669,255 to Wicks issued Jun. 2, 1987 and entitled "Saddle pad to aid difficult horses" discloses a method of aiding difficult horses by using a saddle pad with protective extensions on each side measuring ten inches wide and ten inches long that cover the sensitive area of the intercostal nerve on the horse. This affects the muscles in the lumbar region and hind legs, located just behind and twelve inches above the elbow. Stimulation in this area can cause some horses to become upset through being "cold-backed", sensitive and high strung, previously mistreated and/or injured and thereby difficult to girth, or young horses resistant to saddle and girth when being broken. One or more of these conditions can cause a horse to be uncomfortable and possibly uncooperative and difficult to train. The pad is constructed of top and bottom layers of cotton terry cloth or other suitable material and three inner layers of polyester fiberfill. These layers stitched together create a slight stretch providing a conforming fit to the horse's back and sides. The designated straps on the pad ensure a fit that will prevent slipping and wrinkling. The pad is thick enough for the comfort of the horse and thin enough to allow the rider a close feel of the horse.

U.S. Pat. No. 4,136,506 to Miller issued Jan. 30, 1979 and entitled "Saddle pad" discloses a saddle pad for use in connection with riding saddles, including a base portion, a pair of side panels depending from the base portion, each of the side panels including an outer layer and an inner layer, and slot means in said outer layer so that the panel portion of a riding saddle may be inserted into the slot means and between the outer layer of the side panel and the inner layer of the side panel to stabilize the saddle pad during use.

U.S. Pat. No. 3,971,194 to Morgan issued Jul. 27, 1976 and entitled "Separable double ply saddle pad" discloses a multi-ply pad for disposition between the back of a domestic animal such as a horse and a saddle placed upon the horse's back. The pad includes a first lower ply having a flexible backing layer with a dense fibrous pile layer carried by the undersurface of the backing layer. The first and second layers include corresponding spaced peripheral portions and a fastener structure is provided on the corresponding spaced peripheral portions releasably securing the latter together. The upper and lower plies are free of direct connection with each other, independent of the fastening structure, for at least limited relative shifting of the plies of the pad in the areas thereof spaced from the fastening structure.

U.S. Pat. No. 3,807,136 to Deal issued Apr. 30, 1974 and entitled "Method of Preventing Saddle Sores" discloses a method and apparatus for preventing sores on animals such as horses, caused by saddles and the like. A pad is constructed from a synthetic pile fabric by attaching together two portions of the fabric in a back-to-back relationship. The pad is placed between a harness device and the animal to permit limited relative movement between the device and the animal to reduce frictional rubbing movements against the animal's hide, while permitting air circulation between the pad and the hide.

Great Britain Patent Application No. GB 2282742A to Reilly entitled "Saddle Support Pads" discloses a saddle support apparatus comprising a plurality of deformable panels positioned between the saddle "tree" and the back of the animal.

German Patent Application No. DE 29800448 U1 discloses a saddle cloth made in two parts connected front and back by a small section. The cloth is fixedly connected to a foam rubber pad which can be stitched around the outside onto the cover. The rubber pad is fixed in the middle, right and left next to the spinal area of the horse by touch and close fasteners. Additional padding can be fixed right and left between the saddle cloth and foam rubber. The saddle cloth can be in two completely separate halves each firmly connected to a foam rubber pad.

Despite the broad variety of different techniques and configurations existing under the prior art, none adequately address, inter alia, the issue of withers stress relief, as well as spinal column stress relief. Prior art approaches to spinal stress relief can be summarized as lifting the saddle or pad off the spinal column; however, unless a significant thickness of material is used, little actual stress relief is provided (since there is not adequate clearance between the spinal column and the interfering saddle or pad). This added thickness/height of the saddle, however, causes greater instability of the saddle (and rider) on the animal, due to among other things an elevation of the saddle/rider center of gravity.

Hence, there exists a need for an easy-to-use, lightweight, and effective saddle pad apparatus and method of use which would maximize the animal's comfort, thereby also inherently improving the rider's experience on that animal. Such improved means would ideally provide for largely uninhibited movement of the spinal column of the animal relative to the saddle pad (and saddle), as well as mitigating the tension and abrasion of the saddle pad against the animal's spine, even after extended riding periods. Stress relief targeted for, inter alia, the withers region of the animal would also ideally be provided. These benefits would all ideally be provided using an approach which did not significantly detract from the stability afforded by a closely-fitted saddle and pad.

SUMMARY OF THE INVENTION

The present invention satisfies the aforementioned needs by providing improved apparatus and methods for interfacing a saddle or similar device with a living animal.

In a first aspect of the invention, an improved saddle pad apparatus is provided. In one exemplary embodiment, the apparatus is adapted to support a saddle while substantially mitigating the tension of the apparatus over the spinal column region of a living subject (such as an equine) using a plurality or resiliently coupled pad elements. Optional withers region relief may be additionally/alternatively provided using resiliently mounted pad elements disposed relative to the withers region.

In one exemplary configuration, the apparatus comprises: first and second lateral pad elements each comprising first and second layers, the first layer comprising a sheepskin material, the second layer comprising a substantially fibrous material, the first layer adapted to interface with the skin of the equine, the second layer adapted to interface with a saddle disposed substantially atop the saddle pad apparatus; a central element having first and second sides corresponding to respective ones of the first and second lateral pads; and first and second interface elements coupling respective ones of the lateral pad elements to respective ones of the first and second sides of the central element, at least a portion of the interface elements comprising a substantially resilient material adapted to expand and contract in substantially one dimension, the one dimension being substantially transverse to a longitudinal axis of the central element; wherein at least the central element, the interface elements and the lateral pad elements cooperate to mitigate the tension placed on at least one of the spinal and withers regions by the apparatus.

In a second aspect of the invention, a method of manufacturing a saddle pad is disclosed. In one embodiment, the method comprises: providing first and second pad elements; providing a central element having first and second sides; providing first and second resilient interface elements; coupling the first and second interface elements to respective ones of the first and second pad elements; and coupling the first and second interface elements to respective ones of the sides of the central element. In one variant, the pad elements are formed by: providing a quantity of a first material; providing a quantity of a second material; forming the quantities of the first and second material to a substantially similar shape; and mating the similarly shaped quantities together.

In a third aspect of the invention, a method of mitigating saddle pad stress on an animal during riding is disclosed. In one embodiment, the method comprises: disposing on the animal a saddle pad having at least one central region and at least two lateral regions coupled thereto via resilient couplings; riding the animal; and moving the at least two lateral regions with respect to the at least one central region during the act of riding, the moving absorbing within the resilient couplings at least a portion of the stress which would otherwise be applied to the animal. In one variant, the act of moving comprises moving the at least two lateral regions in a direction substantially transverse to a longitudinal axis of the central element, the longitudinal axis being substantially coextensive with the spine of the animal.

In a fourth aspect of the invention, a saddle pad adapted for mitigating stress on an animal during riding is disclosed. In one embodiment, the saddle pad has at least one central region and at least two lateral regions coupled thereto via resilient couplings, the mitigation of stress being accomplished according to the method comprising: disposing the saddle pad on the animal; disposing a saddle substantially atop the pad; riding the animal; and moving the at least two lateral regions with respect to the at least one central region during the act of riding, the moving absorbing within the resilient couplings at least a portion of the stress which would otherwise be applied to the animal.

In a fifth aspect of the invention, improved saddle pad apparatus adapted to support a saddle while substantially mitigating the tension of the apparatus applied to tissue proximate to both the withers and spinal column regions of an animal is disclosed. In one embodiment, the animal comprises an equine, and the apparatus comprises a plurality of resiliently mounted pad elements each adapted to move in at least one direction relative to at least one of the regions, individual ones of the pad elements further being adapted to move substantially independent of others of the pad elements. In one variant, first, second and third pad elements are provided, the first and second pad elements moving in a substantially lateral direction relative to the spinal column, with the third element being adapted to mitigate the tension on the tissue proximate the withers region by moving in a direction different than the lateral direction.

BRIEF DESCRIPTION OF THE DRAWINGS

FIG. 2*c*-1 is a rear partial cross-sectional view of the pad apparatus of FIG. 2*a* taken along line 2*c*-2*c*, illustrating the relationship of the central element, interface element, and pad element.

FIG. 2*c*-2 is a partial perspective view of the interface element of FIG. 2*c*-1.

DETAILED DESCRIPTION OF THE INVENTION

Figure 1A:
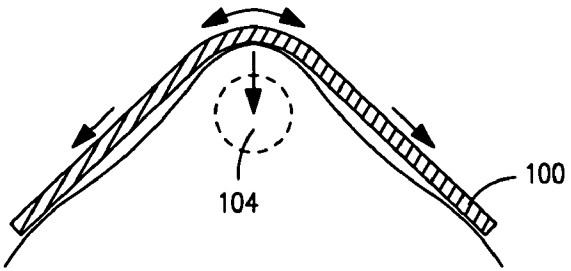
FIG. 1a PRIOR ART
FIGS. 1 and 1*a* are rear elevational views of prior art saddle pad solutions disposed on an exemplary equine, illustrating the tension placed by the pad on the spine during use.

Reference is now made to the drawings wherein like numerals refer to like parts throughout.

It is noted that while the invention is described herein primarily in terms of apparatus and methods for interfacing a saddle with an equine subject, the invention may also be embodied for or adapted to other species including, without limitation, camels, donkeys, mules, burrows, and even elephants. All such adaptations and alternate embodiments are readily implemented by those of ordinary skill in the relevant arts, and are considered to fall within the scope of the claims appended hereto.

As used herein, the terms "withers" and "withered" refer to, without limitation, the bony protrusions proximate the base of the neck of an animal.

As used herein, the term "foam" includes literally any type or material having at least some degree of resilient compressibility.

As used herein, the terms "elastic" and "elastomer" refer generally to any material or aggregation of materials, natural or synthetic, which provide some degree of resiliency when placed under stress (e.g., tensile stress).

Overview

The present invention comprises riding apparatus and methods for use thereof on living animals such as horses. In one exemplary embodiment, the invention comprises a pad having a configuration adapted to maximize comfort to the animal during riding. This pad is also configured to maximize the freedom of motion of the animal, while also providing other desirable qualities including ease of use, stability, low manufacturing cost, and comparatively light weight. The animal benefits from equipment that allows it to move freely, without pain and discomfort and risk of injury (such as for example chafing and pressure sores) that can be caused by restrictive and abrasive prior art pad solutions.

The exemplary embodiment of the pad apparatus disclosed herein incorporates one or more salient improvements, including (i) the use of two lateral elastic interface strips which movably bond the lateral portions of the pad to a central or spinal portion, thereby allowing for free-flowing movement of the spine relative to the lateral portions of the pad during ambulation of the animal; and (ii) a natural and comfortable sheepskin and/or wool element adapted to contact the animal's skin and mitigate adverse effects associated with prior art pads (e.g., capture of moisture from the animal's sweat, irritation of the animal's skin due to rubbing or chafing of the material, etc.); and (iii) use of "Y" shaped interface in the withers region of the pad.

Advantageously, the exemplary apparatus is practical and easy to use, requiring no expensive or bulky mechanisms, materials, or the like. It can be used under all riding conditions, and can be readily cleaned. It is adapted to maintain its position on the anatomy of the animal without slippage, thereby further enhancing its utility and reducing user frustration (and animal discomfort) at having to reposition the apparatus.

Also provided is the benefit of reduced "bulk" under the saddle, so that the saddle's low center of gravity (and hence the rider's stability) is preserved, in contrast to prior art solutions which substantially raise or lift the saddle off the animal's anatomy.

Description of Exemplary Embodiments

Figure 2A:
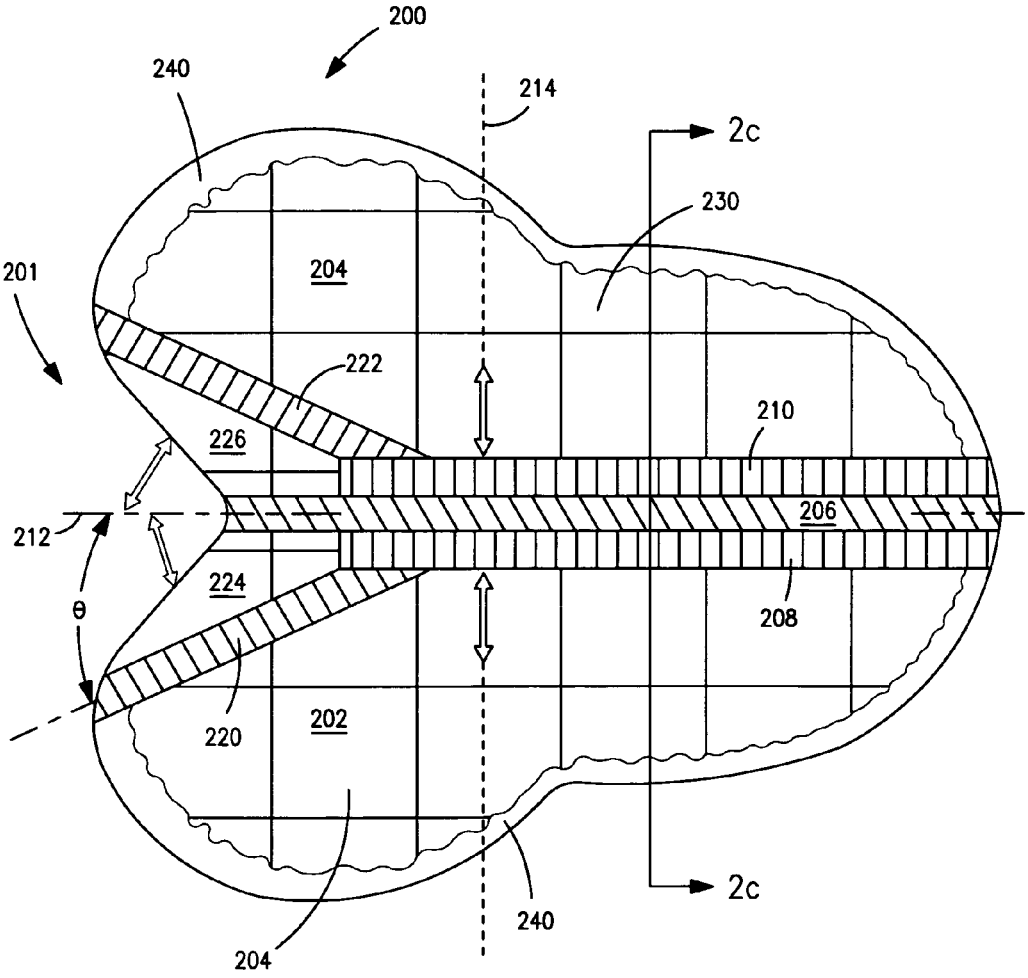
FIG. 2*a* is a top elevational view of a first embodiment of the pad apparatus of the present invention.
Figure 2B:
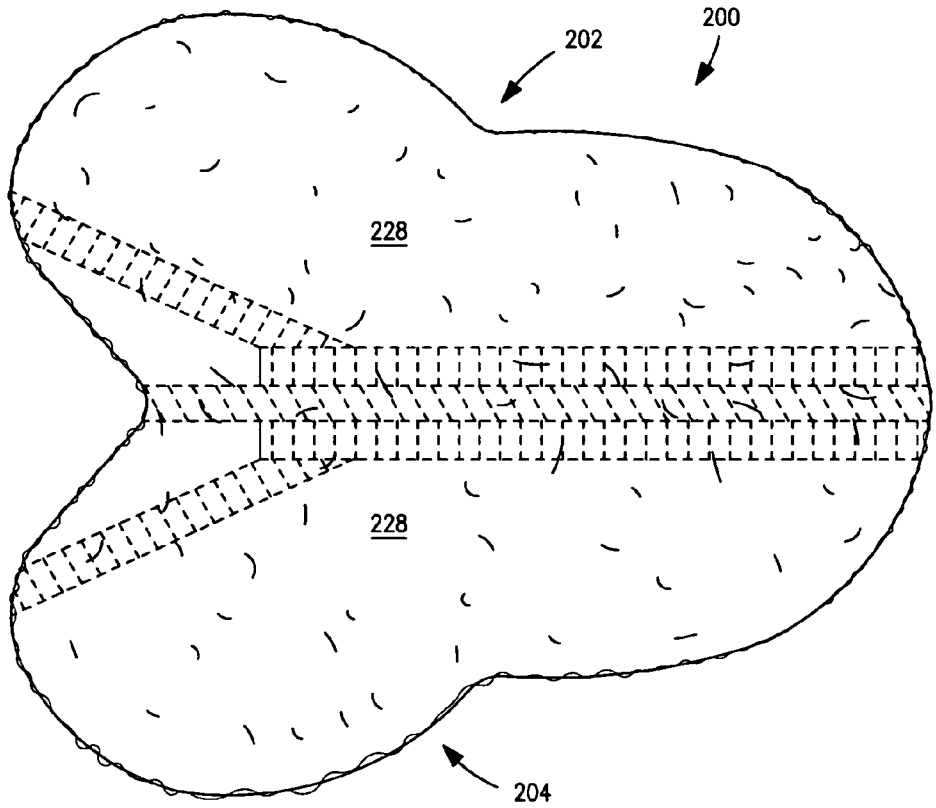
FIG. 2*b* is a bottom elevational view of the pad apparatus of FIG. 2*a*.
Figures 1, 2C:
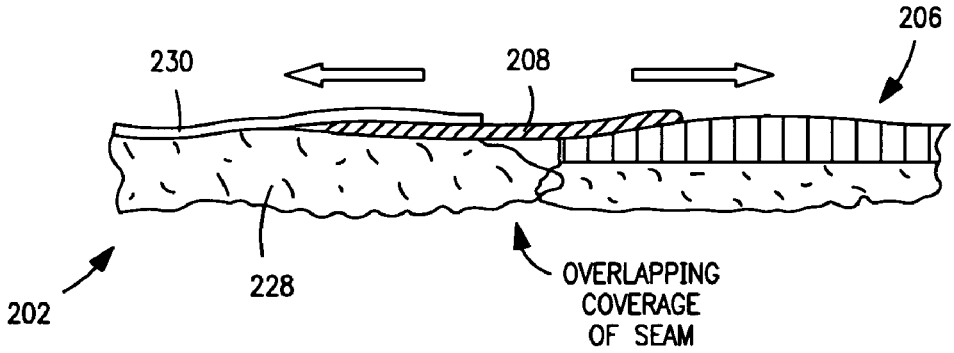
Figures 2, 2C:
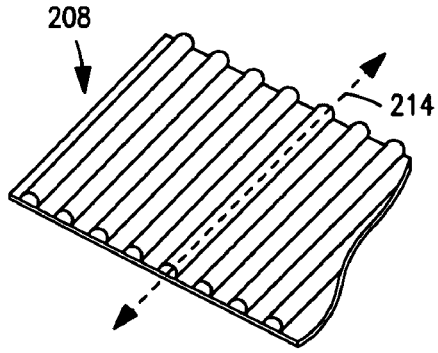

Referring now to FIGS. 2*a* through 2*c*-2 (hereinafter "2*a*-2*c*"), a first exemplary embodiment of the pad apparatus of the present invention is described in detail. As shown in FIGS. 2*a*-2*c*, the improved pad apparatus 300 comprises first and second pad elements 202, 204 which are substantially contiguous with a center element 206 via first and second interface elements 208, 210. As will be described below in greater detail, the first and second pad elements 202, 204 may be comprised of a plurality of different components coupled or bonded together. The pad elements 202, 204 are resiliently coupled to the center element 206 via the resilient interface elements 208, 210, such that the pad elements 202, 204 can move in at least one direction relative to the center element 206.

In the exemplary embodiment, the pads are constrained to move in substantially only one dimension 214; i.e., substantially transverse to the longitudinal axis 212 of the center element 206. This dimension is chosen since it generally corresponds with the dimension in which most stress is applied to the upper portions of the prior art saddle pad solutions (i.e., that region overlying the spine of the animal, corresponding to the center element 206 of the illustrated embodiment). As previously discussed, the interface between the lateral portions of the saddle (and hence saddle pad) and the animal transfer tensile forces to the saddle pad, especially the regions immediately overlying the spinal column and the withers region which are typically not directly impinged upon by the weight of the saddle and rider. Hence, in the illustrated embodiment of the pad 200, any lateral (and downward) tension forces generated on the animal's spinal region are substantially mitigated and dissipated into the resilient interface elements 208, 210 as described in greater detail below, thereby reducing or even eliminating the detrimental effects of such forces on the animal under the prior art.

The design of the pad 200 advantageously allows for the spinal column of the animal to remain substantially unobstructed during ambulation (e.g., walking, trotting, cantering, or full-on galloping), effectively within a channel formed between the two lateral pad elements 202, 204, thereby greatly increasing the comfort to the animal during such movement. As can be appreciated, an animal not experiencing discomfort is more controllable, has better stamina, and arguably has greater longevity and quality of life.

Furthermore, by substantially constraining the movement of the pad elements 202, 204 to this direction 214, "floating" of the pad elements relative to the center element 206 (and any saddle placed atop the pad 200) is avoided, thereby (i) substantially eliminating stress, including within the withers region, and also enhancing the stability of the saddle and saddle pad as a whole. It will be recognized, however, that while the illustrated embodiment purposely seeks to avoid such floating (i.e., movement in multiple dimensions), certain instances may exist where at least some such floating is desirable. Hence, alternate configurations of the invention are envisaged wherein relative motion between the pad elements 202, 204 and the center element 206 is not constrained to one dimension of movement.

In the exemplary embodiment of FIG. 2*a*, the interface elements 208, 210 comprise substantially planar, flexible strips each approximately 2 inches (5.08 cm) wide, although other widths may be used. Elastic type material manufactured by Westip (Textil-Elastik) GMBH of Germany is utilized in the illustrated embodiment, although others may be substituted with equal success. The material is resilient (e.g., elastomeric) in nature, and is particularly chosen and oriented within the pad 200 such that it (i) permits movement in a first desired dimension as previously described, and (ii) substantially frustrates movement in other dimensions. This is accomplished by orienting the longitudinal dimension of the elastomeric fibers of the interface material substantially parallel to the desired direction of movement as shown best in FIG. 2*c*-2. Hence, when a tensile or stretching force is applied in the lateral direction, the material expands accordingly, thereby absorbing stress that would otherwise be transmitted up to the region of the pad proximate to the spinal column. When force is applied in a direction not parallel with the desired direction of movement, the interface material resists movement of the pad element 202, 204 in that direction, with the exception that any component of the force vector in the desired direction will be accommodated. For example, where the applied force vector F is in a direction ( ) degrees from the "desired" (e.g., lateral) direction, the component of this vector in the desired direction is given by Eqn. (1):

$$F_d = F \cos(\Phi) \qquad \text{(Eqn. 1)}$$

where:

F=magnitude of applied force vector $F_d$=component of F in lateral direction

Herein lies a significant feature of the illustrated embodiment; i.e., the use and selective orientation of substantially unidirectional resilient material within the pad 200 in order to control the movement of the pad elements 202, 204.

The degree of resiliency of the material (e.g., "spring constant" k according to the linear relationship F=kx) can be selected so as to provide the desired level of force dissipation while maintaining the desired range of pad element travel (e.g., without reaching the upper travel limit of the interface material). For example, one variant utilizes a broader (wider) interface element with a lower force profile (i.e., easily stretched) so that significant movement of the pad elements 202, 204 relative to the central element 206 can occur without over-stretching the interface elements 208, 210. Another variant utilizes a narrower interface strip, yet with a higher force profile, so that the travel of the associated pad element is less at the same tensile force level. Myriad different combinations and force profiles (including non-linear) are possible consistent with the invention.

As further shown in FIG. 2*a*, the exemplary pad 200 comprises a set of secondary (here, withers) interface elements 220, 222 that are disposed at an oblique angle (θ) relative to the primary interface elements 208, 210, thereby forming a "Y" pattern. These secondary elements 220, 222 are coupled to respective ones of withers pad elements 224, 226 (which may be of similar or different construction and composition from the lateral pad elements 202, 204), each of which are coupled on their interior edges to the central element 206. This substantially triangular or wedge-shaped configuration at the front 201 of the pad 200 is specifically adapted to correspond to the withers region of the animal, and to provide stress and tension mitigation thereto. Through use of the secondary interface elements 220, 222, the withers pads 224, 226 are somewhat articulated within the pad 200, and hence can move somewhat independently from the primary or lateral pad elements 202, 204. This feature advantageously allows the withers pads to move and shape themselves to the particular contours of the animal on which the pad 200 is fitted, and also provides the aforementioned tension/stress mitigation to the withers region during riding. Since the movement of the lateral pads 202, 204 is primarily controlled by the primary interface elements 208, 210, the withers pads (and secondary interfaces 220, 222) can dislocate somewhat without affecting the operation or disposition of the lateral pads 202, 204. Stated differently, the effect of any tension on the secondary interfaces created by dislocation of the withers pads 224, 226 has very little leverage against the much larger primary interfaces 208, 210 and lateral pads 202, 204.

It will also be recognized that while the illustrated embodiment utilizes primary and secondary interface elements which are similar in dimension (e.g., thickness and width) as well as mechanical properties (e.g., resiliency), these dimensions and/or properties can be varied as desired in order to achieve a desired functionality. For example, the width of the secondary interfaces 220, 222 can be increased in order to provide the withers elements 224, 226 with more "give" relative to the lateral pads 202, 204. Alternatively, the resiliency of the material used in the primary interfaces can be made greater or less than that of the secondary interfaces.

Furthermore, while the illustrated embodiment of FIGS. 2*a*-2*c* uses secondary interfaces 220, 220 whose dimension of movement is constrained (as is that of the primary interfaces 208, 210, albeit in a different direction), a heterogeneous approach can be utilized, wherein for example the primary interfaces 208, 210 are constrained to move in one direction, while the secondary interfaces are not, or vice-versa.

Additionally, the dimensions of movement for the primary and secondary interfaces can be adjusted relative to one another through choice and/or manufacturing of the pad 200. For example, while the embodiment of FIG. 2*a* shows that the "active" dimensions of the primary interface elements 208, 210 (i.e., that substantially corresponding to the lateral dimension 214) and secondary elements 220, 222 (i.e., that at an oblique angle θ relative to the lateral dimension 214), one or both sets of the resilient interface elements can be configured such that any angular relationship is provided; e.g., including co-linear or even perpendicular. This can be accomplished by, e.g., cutting the shapes for the resilient interfaces from a swatch of material along lines which are not purely parallel or perpendicular to the material's active direction as in the illustrated embodiment.

It will also be recognized that while substantially linear (straight) resilient interface elements are shown in the exemplary embodiment of FIG. 2*a*, other interface element profiles (such as, e.g., curved, hyperbolic, piece-wise non-linear, combinations of straight and curved, etc.) may be used consistent with the invention. The invention is in no way limited to straight sections of interface material, although this approach does afford the benefit of simplicity and low cost of manufacturing.

It can be appreciated that other types of interface elements may be used in place of or in combination with the resilient material previously described herein. For example, composites of two or more different grades of resilient material having different mechanical or physical properties may be used, such as in a layered fashion. This allows for, e.g., more complex force-versus-displacement profiles for the resilient interfaces 208, 210, 220, 222 as a whole. Alternatively, a thermally active material (i.e., one which changes its profile as a function of temperature) may be used. As yet another alternative, the strip of resilient material may be replaced by a series of parallel straps of material. Many other such variations will be recognized by those of ordinary skill provided the present disclosure.

The shape of the apparatus 200 (best shown in FIGS. 2*a* and 2*b*) is selected so as to be somewhat asymmetrical with respect to a transverse axis 214, yet substantially symmetrical with respect to a longitudinal axis 212. While it will be recognized that other shapes, symmetrical or otherwise, may be used consistent with the invention, the illustrated shape (loosely described as a "half-pad") advantageously conforms to large degree to the anatomy of the animal on which it is placed, as well as providing effectively complete coverage of the animal hide for the saddle which is disposed atop of the pad. Stated differently, the pad shape advantageously avoids any direct contact between the saddle and a hide of the animal, yet provides for only minimal visibility of the pad 200 when the saddle is placed thereon.

Other pad shape configurations useful with the present invention include those larger than the pad 200 (i.e., a "full-pad"), as well as other shape including square, rectangular, etc. Hence, it will be recognized that the riding system of the present invention can be adapted to literally any form.

In the illustrated embodiment, the lower or interior elements 228 of the lateral pad elements 202, 204, and optionally the central element 106, each comprise at least in part a sheepskin material (see FIGS. 2*b* and 2*c*) which is selected for its desirable properties including inter alia, the ability to absorb and dissipate moisture, e.g. animals sweat during use, comfort for the animal, and desirable thermal properties including, for example, the ability to conduct excess heat generated by the animal (or from other sources such as solar radiation) away from muscle/body. Natural sheepskin is an ideal material to provide shock absorption (i.e., dissipation of concussive or other forces to both the animal and the rider), temperature balance and relief from friction, as well as mitigation of the aforementioned pressure points (and prevention of sores or other maladies relating thereto). As is well known, sheepskin is used extensively in the medical field, where it is the material of choice for bedridden and wheelchair-bound people for these reasons. By allowing air to circulate between hair and leather (hide), the sheepskin forms a protective air cushion that also balances the temperature of various regions of the animal in contact therewith. Hence, the saddle pad of the present invention may even be considered therapeutic for the animal (and indirectly, the rider since the general comfort and happiness of the animal can have profound effects on the well-being of the rider).

For best efficiency, the pelt of the sheepskin used for the exemplary pad elements 202, 204 needs to be dense, and should not be too long in hair length. When the hair is too long, it is more prone to undesirable clumping and matting, which reduce air circulation and disposition during use. Furthermore, a very long-haired skin may be thicker than desired. Conversely, anything shorter or pelts with hair that is too soft are not able to properly cushion. Hence, in the illustrated embodiment, the pelt hair length used lies between ¾" and 1", although it will be recognized that other lengths may be utilized consistent with the invention depending on any number of factors including special needs or physiologic features of a specific animal, the desire to raise the saddle higher, the use of a different type of sheepskin (i.e., one more or less dense and/or having a different nominal hair strand thickness), etc.

Furthermore, it will be recognized that myriad different sheepskins are available for use with the invention. As is well known, the region where the sheep producing the skin is raised has significant impact on the feel of the sheepskin. Sheepskins from England, for example, are generally coarser than those from Australia or New Zealand, where climates are milder year round. Hence, the present invention may be practiced using any number of different types of sheepskin, and in fact skins from other species (such as goat, bear, etc.) if desired. Australian Merino sheepskins are used in the illustrated embodiment due to their high quality, reasonable cost, and softness.

The dyeing process may also be considered during selection in as much as the dyes must be of high quality. For example, exemplary high quality dyes that may be used with the invention are manufactured by BASF of Germany. Additional chemical treatments or dyeing processes may be applied if desired in order to make the first element 302 more robust in terms of stain resistance, ultraviolet fading, clumping/matting, etc.

Sheepskin also has desirable properties relating to resistance to accumulated dirt and other detrimental stressors. Sweat and grime are easily curried out and removed with a stiff body brush, and the hair fibers are somewhat naturally resistant to accumulation of these substances. Additionally, good quality sheepskin is machine washable in cold water and on gentle cycle. Any detergent suitable for leather or wool may be used, including, for example, Leather Wash and Conditioning Rinse sold by Leather Therapy, Inc.

Despite the advantages of sheepskin, it will be recognized that other types of materials (natural or otherwise) may be used for the lower portions 228 of the pad elements 202, 204, 224, 226. For example, so-called "synthetic sheepskins" which have many of the same properties as real sheepskin, yet which utilize synthetic fibers such as rayon, Dacron, and the like, may be used, although testing of various synthetic versus natural fibers by the Assignee hereof has indicated that the natural (sheepskin) fibers described above have superior performance to their synthetic counterparts.

Furthermore, it will be appreciated that the pad elements 202, 204, 224, 226 may be comprised of more than one material. For example, in areas where significant potential for rubbing or chafing exists, the aforementioned real sheepskin may be used, while synthetic sheepskin (or another material) is used in areas where the requirements are not so stringent (or optimal performance is not required). Myriad other combinations of materials are possible consistent with the invention.

As shown in FIGS. 2*a* and 2*c*, the upper (saddle) side piece 230 of the exemplary pad elements 202, 204 comprises a substantially quilted fabric (i.e., a natural fiber fabric such as cotton, although natural/synthetic blends, synthetics, or even aramid fiber materials may be used). The upper side piece 230 is substantially identical in shape to the lower (sheepskin) piece 228, thereby facilitating bonding (e.g., stitching) of the two elements 228, 230. The individual sections or pads of the quilt fabric may also be filled with material such as down, particulates, or even foam if desired.

The above-described arrangement of "square" quilted fabric is used in the illustrated embodiment in order to provide reduced bunching of the fabric, although it will be appreciated that various other schemes or arrangements for the upper element 230 may be used consistent with the invention, including for example the use of transverse "bar" quilt shapes, triangles, rectangles, trapezoids, ellipsoids, hemispheres, etc. Larger or smaller quilt topology may also be used.

A seam element or strip (not shown) may be disposed between the two pieces 228, 230 which acts to both bind the pieces in certain regions, and also provide a more rigid and robust base for stitching or other fasteners disposed on the edges of the various pad elements 202, 204, 224, 226 and used to bind the pad elements to their respective interface elements 208, 210, 220, 222. This strip may comprise, for example, a rugged canvas or wool fabric, although other materials (natural or otherwise) may be used.

Furthermore, it will be appreciated that the various saddle pad components 202, 204, 206, 208, 210, 220, 222, 224, 226 can be bonded using any number of different techniques including without limitation sewing, adhesives, threaded fasteners or rivets, or even non-permanent methods such as zippers, Velcro, etc. The sewn variant of the illustrated embodiment, however, has the benefit of mechanical robustness, simplicity, and very low cost.

As shown in FIG. 2*b*, the exemplary embodiment of the pad 200 is constructed so as to substantially cover the seams corresponding to the interface elements 208, 210, 220, 222 on the interior (skin-side) of the pad 200. This approach provides a substantially uniform interface with the animal's skin, thereby avoiding any edges or cavities which may produce a reduced level of comfort for the animal under certain circumstances. This "seamless" interface is accomplished by (i) selecting the resilient interface dimensions and material so as not to be overly wide; and (ii) allowing the sheepskin of the lower pad element layer 228 (and the central element 206) to blossom outward or overhang the interface elements 208, 210, 220, 222 somewhat when attached. The length of the sheepskin hair fibers can also be selected so as to allow the fibers proximate to the interface seams to overlap the interface elements, thereby substantially covering the interfaces. FIG. 2*c* illustrates this feature graphically.

Referring again to FIGS. 2*a* and 2*c*, the central element 206 of the illustrated embodiment comprises an elongated strip approximately 2 inches (5.08 cm) wide which overlays the spinal region of the animal during use. This central element 206 is coupled to the interface elements 208, 210 via stitching (or any other mechanism previously described). The exemplary central element comprises a thick (e.g., ¾-1 inch effective thickness) sheepskin material, although other materials (such as, e.g., wool) and thickness values may be used as desired. The central element may also comprise a lower (skin-side) layer of sheepskin or a comparable material to protect the spinal region of the animal from chafing or other deleterious effects, as best shown in the embodiments of FIGS. 2*b* and 2*c*.

The sizing and shape of the pad apparatus 200 are also made to allow ready fixation to the saddle via a plurality of optional tethers or straps (not shown). The straps may be constructed of e.g., a high strength nylon material and are adapted for routing to the billet straps, thereby allowing the pad to be retained to the saddle while not showing the straps when the saddle is mounted atop the pad 200. This feature maintains the esthetic appearance of the saddle and pad, without sacrificing the firm bonding between the pad and saddle. The coupling between the pad and saddle is significant from the standpoint that it is highly undesirable to have the pad move with relation to the saddle in either position or orientation during riding.

Figure 2D:
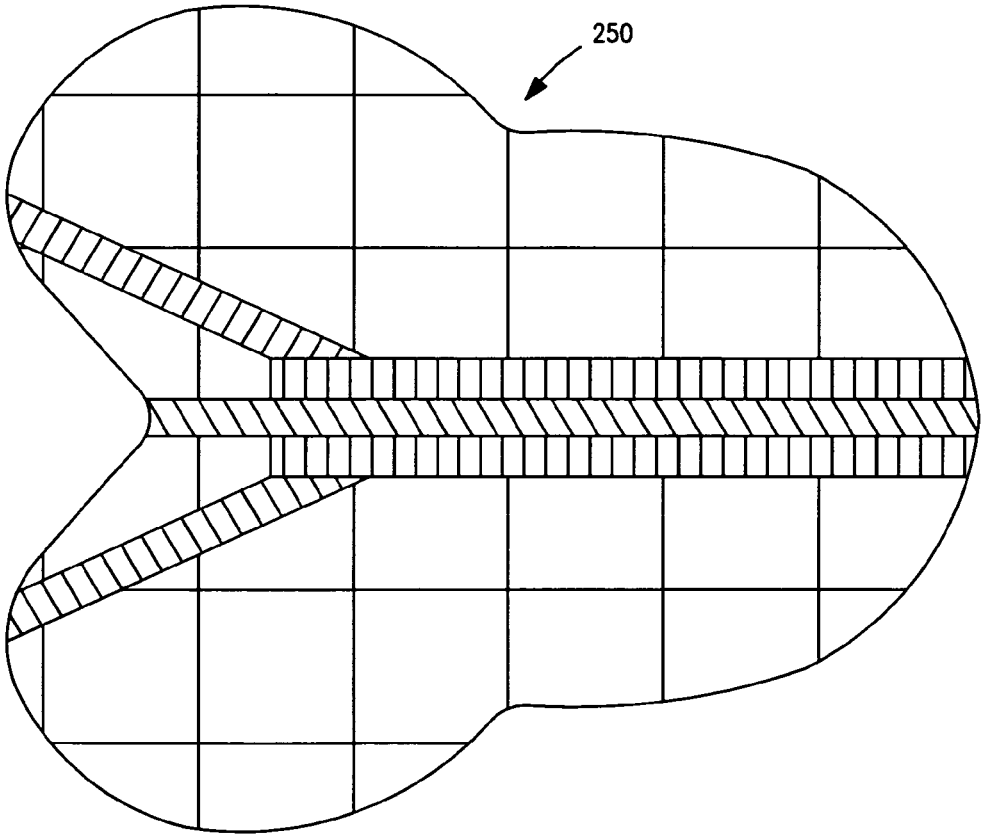
FIG. 2*d* is a top elevational view of another exemplary embodiment of the pad apparatus of the invention, without an outer peripheral ridge.

The exemplary embodiment of the pad apparatus 200 of FIG. 2*a* further comprises an optional peripheral ridge or raised region 240 which is adapted to reside just outside of the periphery of the saddle when the latter is placed on the pad 200 properly. In this fashion, the edge of the saddle acts to engage the ridge 240, thereby providing additional stability and coupling between the saddle and the pad 200. Hence, even without any straps as previously described (or when the straps are not tightly coupled to the saddle), the relative positions of the saddle and the pad are substantially maintained by both the friction between the two surfaces; i.e. the top surface of the second element and the interior surface of the saddle, as well as the ridge 240 which engages the outer rear periphery of the saddle. The ridge comprises a thick, doubled-over portion of the sheepskin lower element 228, although other constructions may be utilized. It will be appreciated that the ridge can also be made to extend or exist in frontal portions of the pad 200 (i.e., on the front edges of the withers pads 224, 226), cooperating with corresponding frontal portions of the saddle, although some degree of mobility between the two components is required so that the stress-relieving functions of the pad elements is not frustrated. FIG. 2*d* illustrates a variant 250 of the pad 200 of FIGS. 2*a*-2*c*, wherein no ridge 240 is employed.

The "spine straddling" approach of the present embodiment provides a distinct benefit over the prior art solutions, which make no account of tension applied by the saddle pad to the spinal column (and withers) of the animal. Under the prior art approaches (most notably the "tablet" type described previously herein), the spinal column of the animal effectively pulls on the tensioned pad repetitively during movement, thereby potentially impeding the motion of the animal and causing chafing. Under the present invention, the substantially wavelike or sinusoidal motion of the spinal column of the animal during ambulation is fully accommodated even under the most extreme conditions, since the central element 206 will "float" (at least in the transverse dimension) relative to the lateral pad elements 202, 204 under control of the interface elements 208, 210. Similarly, the withers pad(s) 224, 226 essentially float under the control of the secondary interface elements 220, 222, thereby avoiding any restriction or chafing.

It will be appreciated that while embodiments utilizing either only spinal tension mitigation or both spinal and withers region mitigation are described in detail, embodiments having only withers protection can be readily fashions as well if desired.

Furthermore, while embodiments showing two lateral pad elements and a single central element are shown, it will be recognized that other approaches may be used. For example, two or more pad elements can be disposed on each side of the central element (whether in serial or parallel fashion). Alternatively, the central element can be obviated in favor of a direct coupling approach, wherein the interface elements on either side can be mated together directly (or replaced with a single element) that straddles the spinal region. This allows a simplified construction, yet also necessitates the inclusion of a lower layer (e.g., sheepskin) or similar mechanism under the single interface element in order to prevent the expanded interface element material from pinching of abrading the animal's skin, such as upon contraction.

Figure 3A:
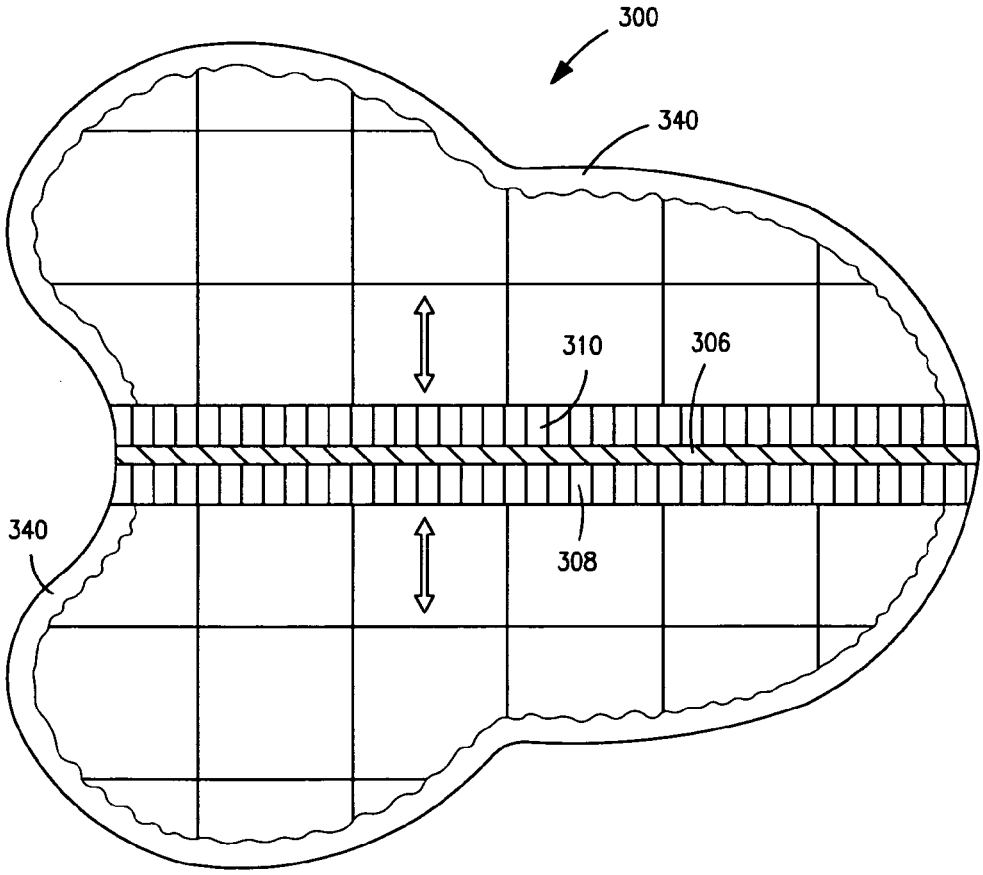
FIG. 3*a* is a top elevational view of another embodiment of the pad apparatus of the present invention.
Figure 3B:
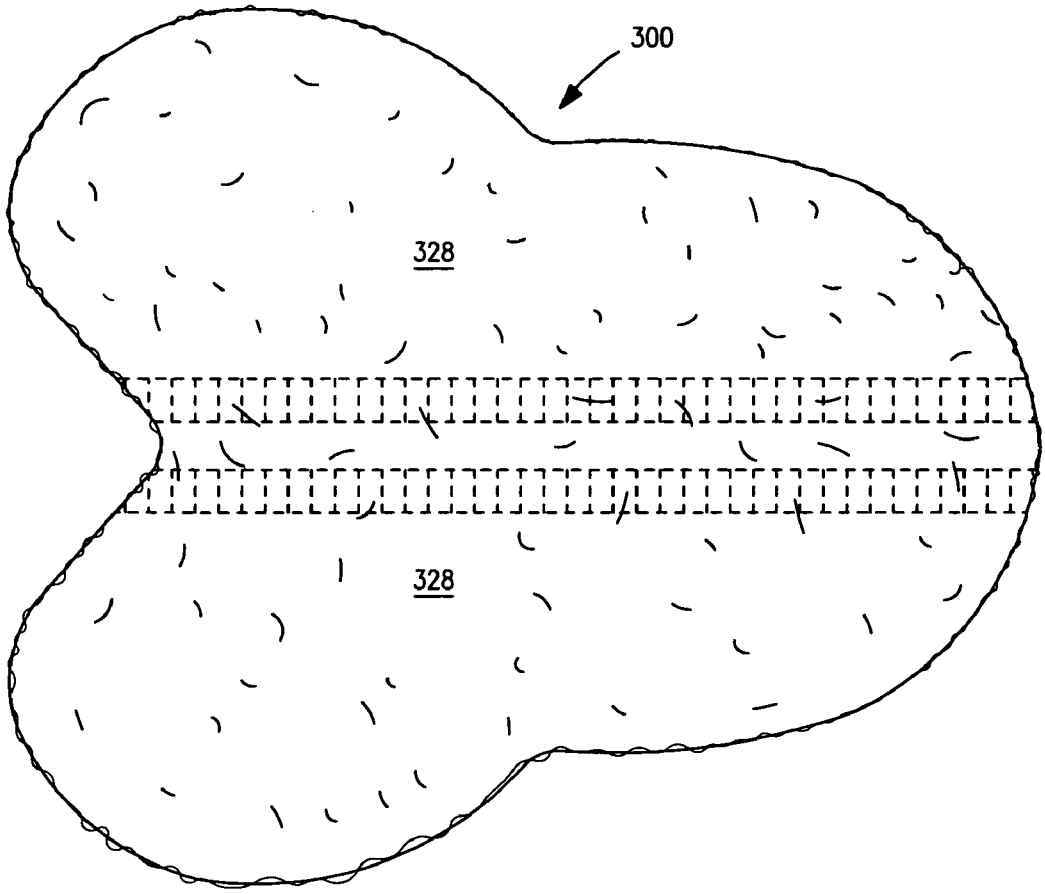
FIG. 3*b* is a bottom elevational view of the pad apparatus of FIG. 3*a*.
Figure 3C:
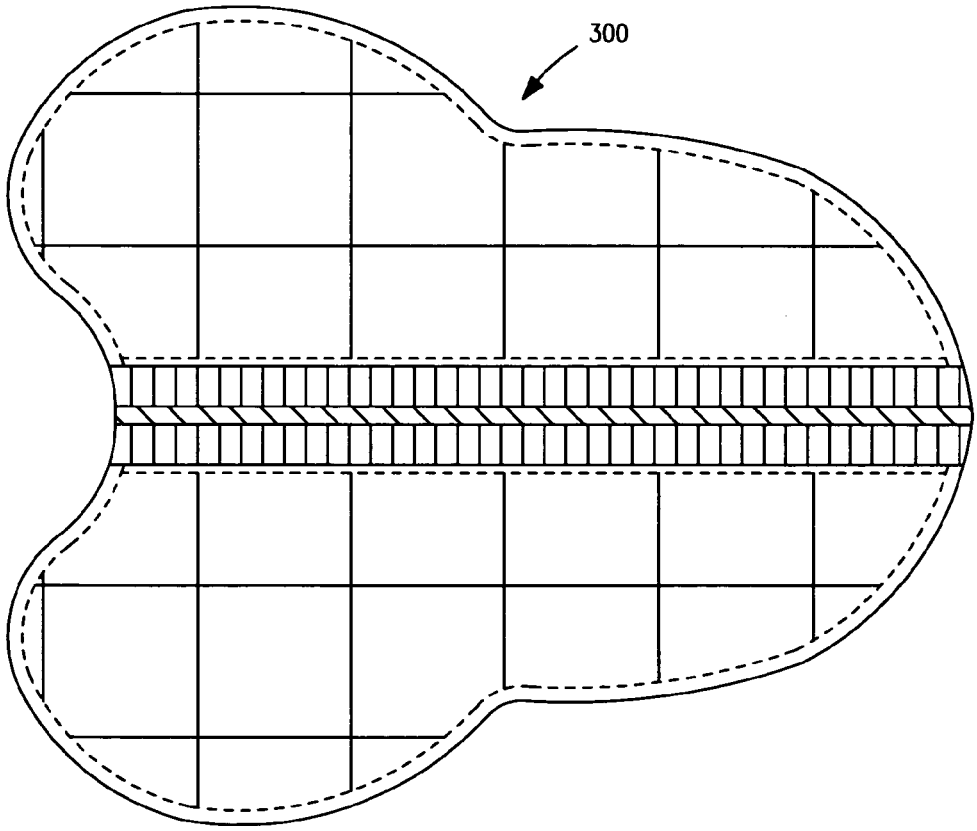
FIG. 3*c* is a top elevational view of yet another exemplary embodiment of the pad apparatus of the invention, without an outer peripheral ridge.

Referring now to FIGS. 3*a*-3*c*, another alternate embodiment of the pad apparatus of the invention is shown. In this embodiment, the pad 300 comprises only two substantially linear interface elements 308, 310 disposed on respective sides of the central element 306. The lower surface 328 comprises a sheepskin material as previously described, with overlapping (seam) coverage as shown in FIG. 3*b*. The pad 300 may have a peripheral ridge 340 as in FIG. 3*a*, or not (see FIG. 3*c*).

Figure 4:
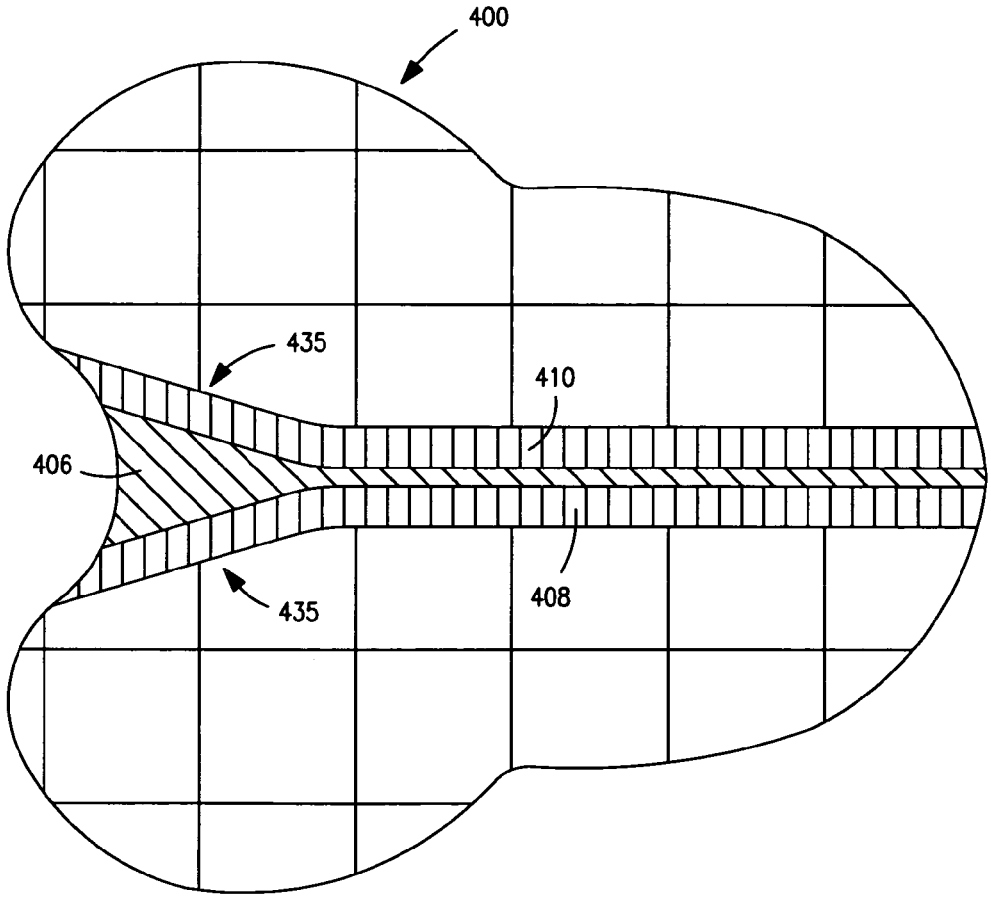
FIG. 4 is a top elevational view of still another embodiment of the pad apparatus of the present invention, wherein divergent interface elements are utilized.

FIG. 4 illustrates yet another embodiment of the invention, wherein the pad 400 comprises two interface elements 408, 410 which each include an expanded or divergent region 435 at the front of the pad 400 which further includes some curvature, such expanded/curved regions 435 allowing for an increased level of compliance in the withers region in order to mitigate stress on the animal's withers. The central element 406 also includes and expanded region 438 coincident with the regions 435 of the interface elements. This provides generally comparable functionality to that of the embodiment of FIG. 2*a*, yet in a somewhat simplified construction.

It will also be noted that the saddle pad apparatus disclosed herein (any variant) can be used in conjunction with one or more aspects of the saddle pad apparatus of co-owned and co-pending U.S. patent application Ser. No. 10/692,835 filed Oct. 23, 2003 and entitled "Riding Apparatus and Method", incorporated herein by reference in its entirety. This latter apparatus provides in effect a coordinated system of benefits, all cooperating to maximize saddle fit and balance, as well as the comfort of the animal. This system comprises, inter alia: (i) removable pad inserts disposed laterally to the spine of the animal, thereby mitigating any interference between the inserts and spine, and allowing for free-flowing movement of the spine during ambulation of the animal; (ii) use of pad insert materials (e.g., visco-elastic foam) which are substantially conformal to the shape of the animal (and saddle), yet provide the desired level of support and resiliency without causing additional pressure points; and (iii) strategic placement (and shaping) of the aforementioned pad inserts to properly place and leverage the saddle against the animal during riding so as to mitigate undesirable shifting and imbalance of the saddle, and the creation of "pressure points" on the animal's musculature, which may restrict blood flow to the affected area(s) and cause discomfort (and potentially injury) to the animal.

For example, the saddle pad apparatus 200 of the present invention can be configured with pockets to receive one or more of the aforementioned pad inserts within the lateral pad elements 202, 204. Any number of other combinations of these inventions will be appreciated by those of ordinary skill provided the present disclosure.

Method of Manufacturing

Figure 5:
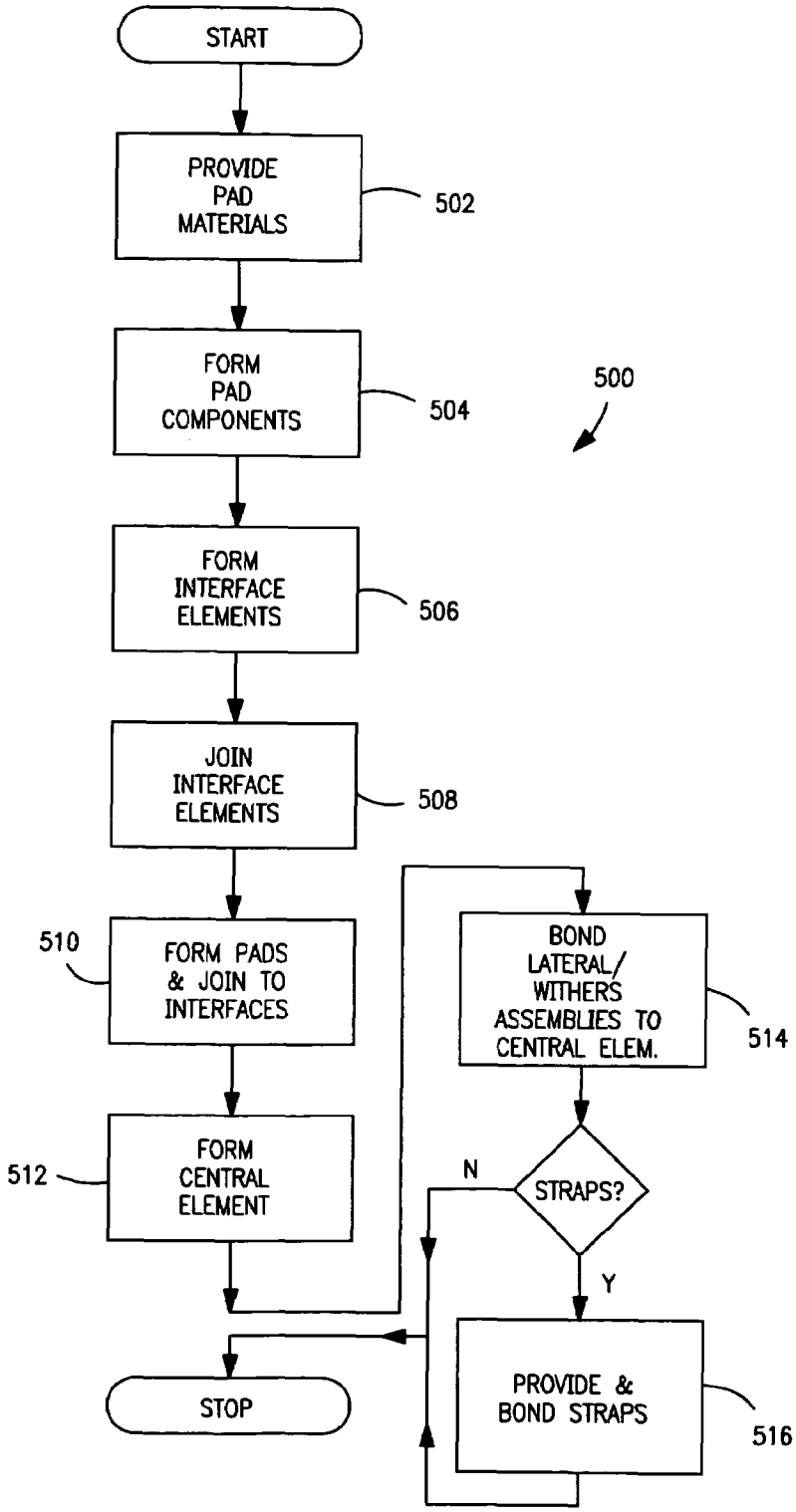
FIG. 5 is logical flow diagram illustrating one exemplary embodiment of the method of manufacturing the saddle pad apparatus of the invention.

Referring now to FIG. 5, a method of manufacturing the pad apparatus of the present invention is described. It will be appreciated that while the following embodiment is described in terms of the apparatus 200 of FIGS. 2*a*-2*c*, the methods may be readily adapted to any of the variants or embodiments disclosed herein, such adaptations being readily implemented by those of ordinary skill.

As shown in FIG. 5, the method 500 generally comprises first providing sheets or other forms of the material used for both the upper and lower pieces 228, 230 of the pad elements 202, 204, 224, 226 (step 502). As discussed previously herein, the exemplary embodiment of these pieces comprises sheepskin and quilted fiber material, respectively, although others may be used. The quilted fiber may be procured as un-quilted fabric and then sewn as desired, or alternatively obtained as pre-quilted fabric.

Per step 504, the material sheets are then measured and the template provided which is overlaid on to the sheets for cutting of the sheet according to the template. Alternatively, the various pieces 228, 230 can be cut using a machine or any other technique suitable to produce the desired shape(s).

Next, the interface elements 208, 210, 220, 222 are formed, such as by cutting the desired shapes from a roll of the resilient material (step 506). As previously described, the choice of material and orientation are critical under certain embodiments of the invention in order to provide a uni-dimensional translation of the pad elements 202, 204 relative to the central element 206.

Per step 508, the two sets of interface elements 208, 220 and 210, 222 are joined together (such as via stitching) in order to provide one integrated interface element for each side of the pad 200.

Figure 1:
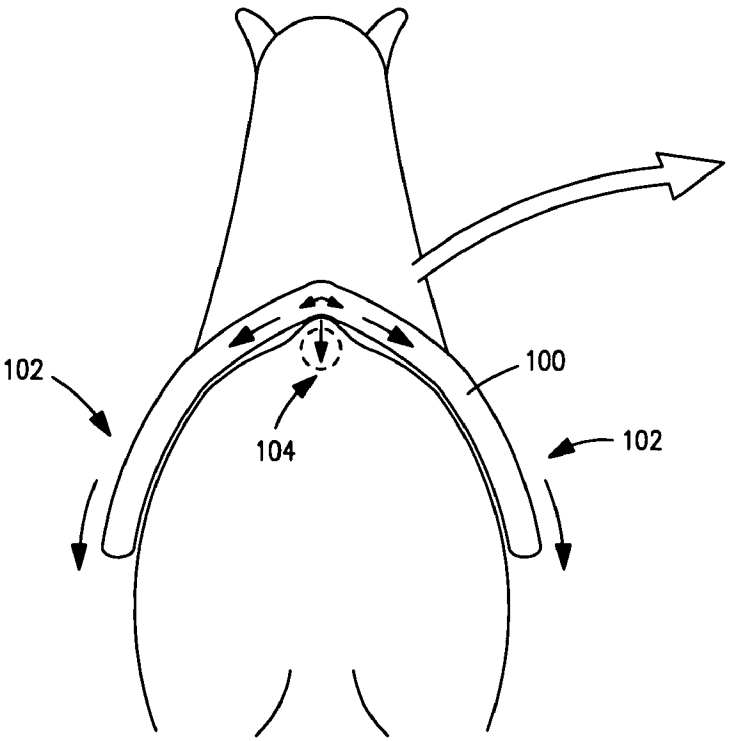
FIG. 1 PRIOR ART

The pad elements are then formed by bonding (e.g., stitching) the pad and interface element components together (step 510). As shown in FIG. 2*c*-1, either a "sandwich" approach can be used (i.e., where the relevant edge of the interface element is tucked between the upper and lower pieces 230, 228 of the pad element), or alternatively a "top" approach (i.e., where the edge of the interface element is simply sewn or bonded onto the top surface of the upper element 230 (or central element 206). If a peripheral ridge 240 is employed, this ridge is also formed by providing an extra periphery of the lower (e.g., sheepskin) material 228, and curling this upward over the top of the upper layer 230 as shown in FIG. 2*a* and bonding this curled edge in place.

The central element 206 is then formed (step 512), such as by (i) providing a strip of thick wool of the proper dimensions, and (ii) optionally bonding (e.g., sewing) the lower sheepskin or similar layer onto the bottom of the wool strip. This forms an assembly of the type shown in FIG. 2*c*.

Per step 514, the assembled lateral and withers pads (and interface elements) for each side of the pad 200 are then bonded (e.g., sewn) onto respective sides of the assembled central element 206.

Next, per step 516, the various other components of the apparatus including any straps, etc., are provided, if used.

These may be manufactured from scratch, or alternatively procured from a third party source, or any combination thereof. The straps are sewn to the appropriate regions of the second element upper pieces 230 of the lateral pad elements 202, 204. This completes the manufacturing process.

It is noted that many variations of the methods described above may be utilized consistent with the present invention. Specifically, certain steps are optional and may be performed or deleted as desired. Similarly, other steps (such as additional stitching, chemical treatment, testing, etc.) may be added to the foregoing embodiments. Additionally, the order of performance of certain steps may be permuted, or performed in parallel (or series) if desired. Hence, the foregoing embodiments are merely illustrative of the broader methods of the invention disclosed herein.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. Saddle pad apparatus for use on an equine having a spinal region and a withers region, comprising:

first and second lateral pad elements each comprising first and second layers, said first layer comprising a sheepskin material, said second layer comprising a substantially fibrous material, said first layer adapted to interface with the skin of said equine, said second layer adapted to interface with a saddle disposed substantially atop said saddle pad apparatus;

a central element having first and second sides corresponding to respective ones of said first and second lateral pad elements; and first and second interface elements coupling respective ones of said lateral pad elements to respective ones of said first and second sides of said central element, at least a portion of said interface elements comprising a substantially resilient material adapted to expand and contract in substantially one dimension, said one dimension being substantially transverse to a longitudinal axis of said central element;

wherein at least said central element, said interface elements and said lateral pad elements cooperate to substantially mitigate the tension placed on both said spinal and withers regions by said apparatus.

2. The apparatus of claim 1, wherein said at least a portion of said interface elements comprises a plurality of elastomeric fibers having longitudinal axes disposed substantially perpendicular to said axis of said central element.

3. The apparatus of claim 1, wherein said central element comprises a wool strip.

4. The apparatus of claim 1, wherein said interface elements comprise a first section disposed substantially parallel with said axis of said center element, and a second section disposed at an oblique angle to said axis.

5. The apparatus of claim 4, further comprising at least one third pad element, said at least third pad element is mated to said second sections of said first and second interface elements.

6. Saddle pad apparatus adapted to support a saddle while substantially mitigating the tension of the apparatus over the spinal column and withers regions of a living subject, said apparatus further comprising:

a plurality of pad elements disposed laterally to a central pad element;

a plurality of interface elements each providing a variable interface between a respective one of said pad elements and said central pad element; and at least one withers region element coupled to at least one of said interface elements.

7. The apparatus of claim 6, wherein said plurality of pad elements comprises two pad elements, said plurality of interface elements comprises two interface elements, and said at least one withers region element is coupled to each of said two interface elements.

8. The apparatus of claim 6, wherein said pad elements comprise a first layer and a second layer comprising sheepskin and a fiber-based material, respectively, said sheepskin being disposed to contact the skin of said living subject, said fiber-based material being disposed to contact said saddle.

9. The apparatus of claim 6, wherein said living subject comprises an equine.

10. The apparatus of claim 6, wherein said apparatus is further adapted to mitigate rocking of said saddle back and forth on said living subject during riding using at least one insert element.

11. The apparatus of claim 6, further comprising first and second restraining straps each being adapted for substantially concealed tethering to said saddle.

12. The apparatus of claim 6, further comprising at least one peripheral ridge disposed substantially along a front or back periphery of said pad elements, said peripheral ridge cooperating with an edge of said saddle to substantially frustrate relative motion between said saddle pad and said saddle in at least one direction during riding.

13. Saddle pad apparatus adapted to support a saddle while substantially mitigating the tension of the apparatus over the spinal column and withers regions of a living subject comprising:

a plurality of pad elements disposed laterally to a central pad element; and a plurality of interface elements each providing a variable interface between a respective one of said pad elements and said central pad element;

wherein at least a portion of said interface elements comprise elastic material, said elastic material adapted to expand and contract in substantially only one dimension.

14. The apparatus of claim 13, wherein said pad elements comprise a first layer and a second layer comprising sheepskin and a fiber-based material, respectively, said sheepskin being disposed to contact the skin of said living subject, said fiber-based material being disposed to contact said saddle.

15. The apparatus of claim 14, wherein said living subject comprises an equine.

16. The apparatus of claim 13, wherein said apparatus is further adapted to mitigate rocking of said saddle back and forth on said living subject during riding using at least one insert element.

17. The apparatus of claim 13, further comprising first and second restraining straps each being adapted for substantially concealed tethering to said saddle.

18. The apparatus of claim 13, further comprising at least one peripheral ridge disposed substantially along a front or back periphery of said pad elements, said peripheral ridge cooperating with an edge of said saddle to substantially frustrate relative motion between said saddle pad and said saddle in at least one direction during riding.

19. A method of manufacturing a saddle pad, comprising:

providing first and second pad elements, wherein said act of providing first and second pad elements comprises providing a quantity of a first material, providing a quantity of a second material, forming said quantities of said first and second material to a substantially similar shape and mating said similarly shaped quantities together;

providing a central element having first and second sides;

providing first and second resilient interface elements, wherein said act of providing first and second resilient interface elements comprises providing resilient material which has at least a portion that is adapted to expand and contract in substantially only one dimension;

coupling said first and second interface elements to respective ones of said first and second pad elements; and coupling said first and second interface elements to respective ones of said sides of said central element.

20. The method of claim 19, wherein said acts of coupling said interface elements comprises coupling said at least a portion of said interface elements between said central element and respective ones of said pad element such that said one dimension is substantially transverse to a longitudinal axis of said central element.

21. The method of claim 19, wherein said act of forming comprises using a template to identify where said materials should be cut, and subsequently cutting said materials substantially according to said template.

22. The method of claim 19, wherein said act of providing a quantity of said first and second materials comprises providing a quantity of sheepskin and a quantity of a fabric, respectively.

23. A method of manufacturing a saddle pad, comprising:

providing first and second pad elements;

providing a central element having first and second sides;

providing first and second resilient interface elements;

coupling said first and second interface elements to respective ones of said first and second pad elements;

coupling said first and second interface elements to respective ones of said sides of said central element;

providing a third pad element; and coupling said third pad element to at least said first and second interface elements.

24. The method of claim 23, wherein said act of providing a third pad element comprises providing first and second sub-elements, said act of coupling said third pad element to at least said first and second interface elements further comprises coupling said sub-elements to respective ones of said interface elements, and coupling both of said sub elements to respective ones of said first and second sides of said central element.

25. The method of claim 23, wherein said act of providing first and second interface elements comprises providing resilient material which is adapted to expand and contract in substantially only one dimension, and said acts of coupling said interface elements comprises coupling said interface elements between said central element and respective ones of said pad element such that said one dimension is substantially transverse to a longitudinal axis of said central element.

26. Saddle pad apparatus adapted to support a saddle while substantially mitigating the tension of the apparatus applied to tissue proximate to both the withers and spinal column regions of an equine, said apparatus comprising:

a plurality of resiliently mounted pad elements each adapted to move in at least one direction relative to at least one of said regions, individual ones of said pad elements further being adapted to move substantially independent of others of said pad elements, wherein said plurality of pad elements comprises first and second pad elements adapted to move in a substantially lateral direction relative to said spinal column; and a third resiliently mounted pad element, said third element being adapted to mitigate said tension on said tissue proximate said withers region by moving in a direction different than said lateral direction.

27. The apparatus of claim 26, wherein said apparatus does not appreciably elevate said saddle from the anatomy of said equine, thereby maintaining a center of gravity for said saddle which is substantially identical to that provided by a saddle pad.

* * * * *